US009219326B2

(12) United States Patent
Zhang

(10) Patent No.: US 9,219,326 B2
(45) Date of Patent: Dec. 22, 2015

(54) MODULAR JACK HAVING INLINED PRINTED CIRCUIT BOARD

(71) Applicant: HON HAI PRECISION INDUSTRY CO., LTD., New Taipei (TW)

(72) Inventor: Zhi-Cheng Zhang, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/150,786

(22) Filed: Jan. 9, 2014

(65) Prior Publication Data

US 2014/0194009 A1 Jul. 10, 2014

(30) Foreign Application Priority Data

Jan. 9, 2013 (CN) ..... 2013 1 0007069

(51) Int. Cl.

| | |
|---|---|
| ***H01R 24/00*** | (2011.01) |
| ***H01R 13/514*** | (2006.01) |
| ***H01R 13/66*** | (2006.01) |
| ***H01R 24/64*** | (2011.01) |
| *H01R 13/516* | (2006.01) |

(52) U.S. Cl.

CPC ..... *H01R 13/514* (2013.01); *H01R 13/6658* (2013.01); *H01R 24/64* (2013.01); *H01R 13/516* (2013.01); *H01R 2201/04* (2013.01)

(58) Field of Classification Search

CPC ..... H01R 24/00; H01R 12/55

USPC ..... 439/676, 76.1

See application file for complete search history.

(56) References Cited

U.S. PATENT DOCUMENTS

| | | | | |
|---|---|---|---|---|
| 6,139,368 | A * | 10/2000 | Bogese, II | 439/620.17 |
| 6,457,993 | B1 * | 10/2002 | Espenshade | 439/490 |
| 6,623,306 | B2 * | 9/2003 | Xu et al. | 439/676 |
| 6,719,588 | B1 * | 4/2004 | Zheng et al. | 439/620.04 |
| 7,018,242 | B2 * | 3/2006 | Brown et al. | 439/676 |
| 8,246,389 | B2 * | 8/2012 | Zhang et al. | 439/676 |
| 8,439,705 | B2 * | 5/2013 | Zhang | 439/607.06 |
| 2003/0119370 | A1 * | 6/2003 | Xu et al. | 439/676 |
| 2004/0082223 | A1 * | 4/2004 | Hyland et al. | 439/620 |
| 2005/0181643 | A1 * | 8/2005 | Brower et al. | 439/76.1 |
| 2006/0014410 | A1 * | 1/2006 | Caveney | 439/188 |
| 2014/0045374 | A1 * | 2/2014 | Tang et al. | 439/569 |
| 2014/0170904 | A1 * | 6/2014 | Tang et al. | 439/620.23 |
| 2014/0308849 | A1 * | 10/2014 | Hsu et al. | 439/607.55 |

FOREIGN PATENT DOCUMENTS

| | | | |
|---|---|---|---|
| CN | 2523068 | Y | 11/2002 |
| CN | 201230076 | Y | 4/2009 |
| CN | 201252263 | Y | 6/2009 |
| CN | 201498812 | U | 6/2010 |
| CN | 101908683 | A | 12/2010 |
| CN | 102055119 | A | 5/2011 |
| CN | 202474375 | U | 12/2012 |
| CN | 202917709 | U | 5/2013 |

* cited by examiner

*Primary Examiner* — Abdullah Riyami
*Assistant Examiner* — Nader J Alhawamdeh
(74) *Attorney, Agent, or Firm* — Wei Te Chung; Ming Chieh Chang

(57) ABSTRACT

A modular jack (100) includes an insulative housing (1), a printed circuit board assembly (3), a set of mating terminals (2) and a set of footer pins (4). The insulative housing (1) defines a mating port (16) and a mounting port (19) located behind thereof. The printed circuit board assembly are mounted in the mounting port in an oblique manner. The footer pins are directly assembled to the insulative housing for omitting an insulative carrier and reduce a process assembling the footer pins with the insulative carrier.

20 Claims, 7 Drawing Sheets

MODULAR JACK HAVING INLINED PRINTED CIRCUIT BOARD

BACKGROUND OF THE INVENTION

1. Field of the Invention

The present invention relates to the field of modular jacks suitable for use in data communication, more specifically to a modular jack that includes an inclined printed circuit board.

2. Description of Related Art

U.S. Pat. No. 5,069,641 issued to Sokamoto et al. On Dec. 3, 1991, discloses a modular jack with an internal printed circuit board arranged vertically. U.S. Pat. No. 7,018,242 B2, issued to Brown et al. on Mar. 28, 2006, discloses a modular jack including an insulative housing, a plurality of mating terminals for mating with a modular plug, a plurality of footer pins for mounting onto an exterior printed circuit board, and at least one internal printed circuit board linked between the mating terminals and the footer pins wherein such an internal printed circuit board can be arranged either horizontally or obliquely different from that disclosed in the aforementioned U.S. Pat. No. 5,069,641.

A modular jack having a rubust structure is desired.

SUMMARY OF THE INVENTION

The present invention provides a modular jack including an insulative housing, a printed circuit board, a set of mating terminals and a set of footer pins. The insulative housing includes a bottom wall, two side walls, a front wall connecting with the bottom wall and the two side walls, and a middle wall extending parallel with the front wall. The middle wall divides the insulative housing into a mating port for receiving a modular plug and a mounting port located behind of the mating port. The mating port is recessed from the front wall. The insulative housing having a mounting post extending downwardly from the lower wall for inserting into an exterior substrate. The printed circuit board has an upper portion and a lower portion. The printed circuit board is disposed in the mounting port in an oblique manner under condition that the upper portion is disposed in front of the lower portion.

Each mating terminal has a contact portion exposed to the mating port and a tail portion connected with the upper portion. Each footer pin has a mounting portion for mounting onto the exterior substrate, a retention portion fixed by the bottom wall of the insulative housing and a head portion connected with the lower portion of the printed circuit board.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Referring to FIGS. 1-5 illustrate a first embodiment of the present invention.

Figure 1:
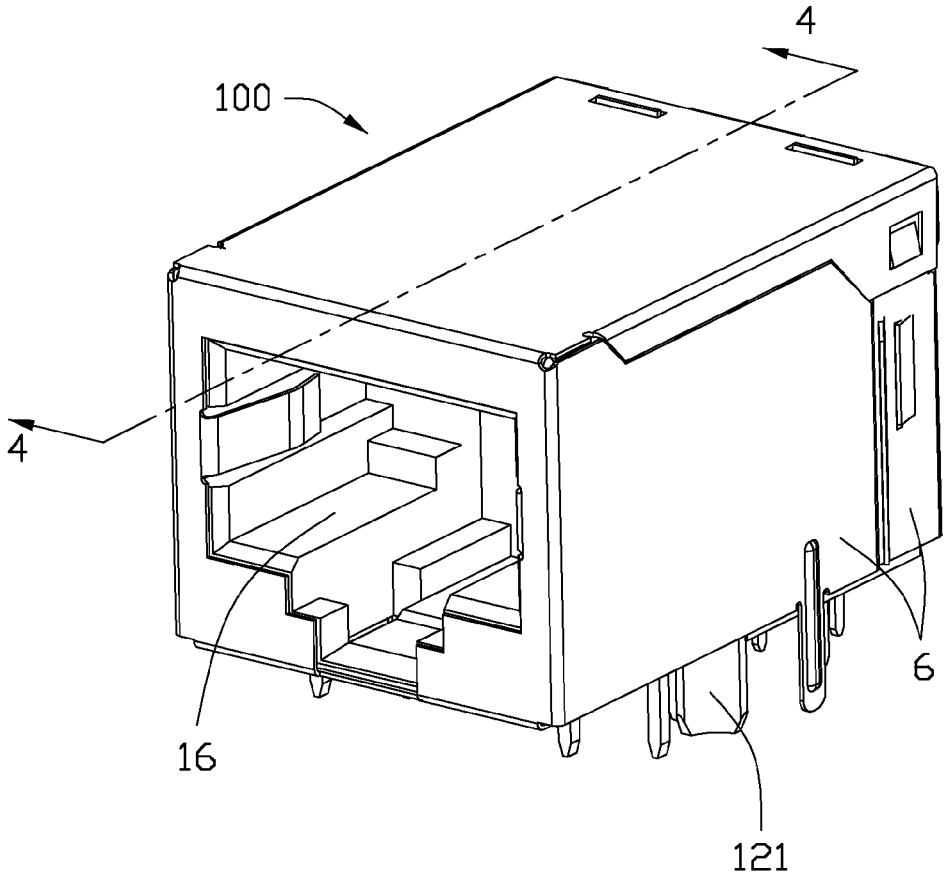
FIG. 1 is a perspective view of an embodiment of a modular jack.
Figure 2:
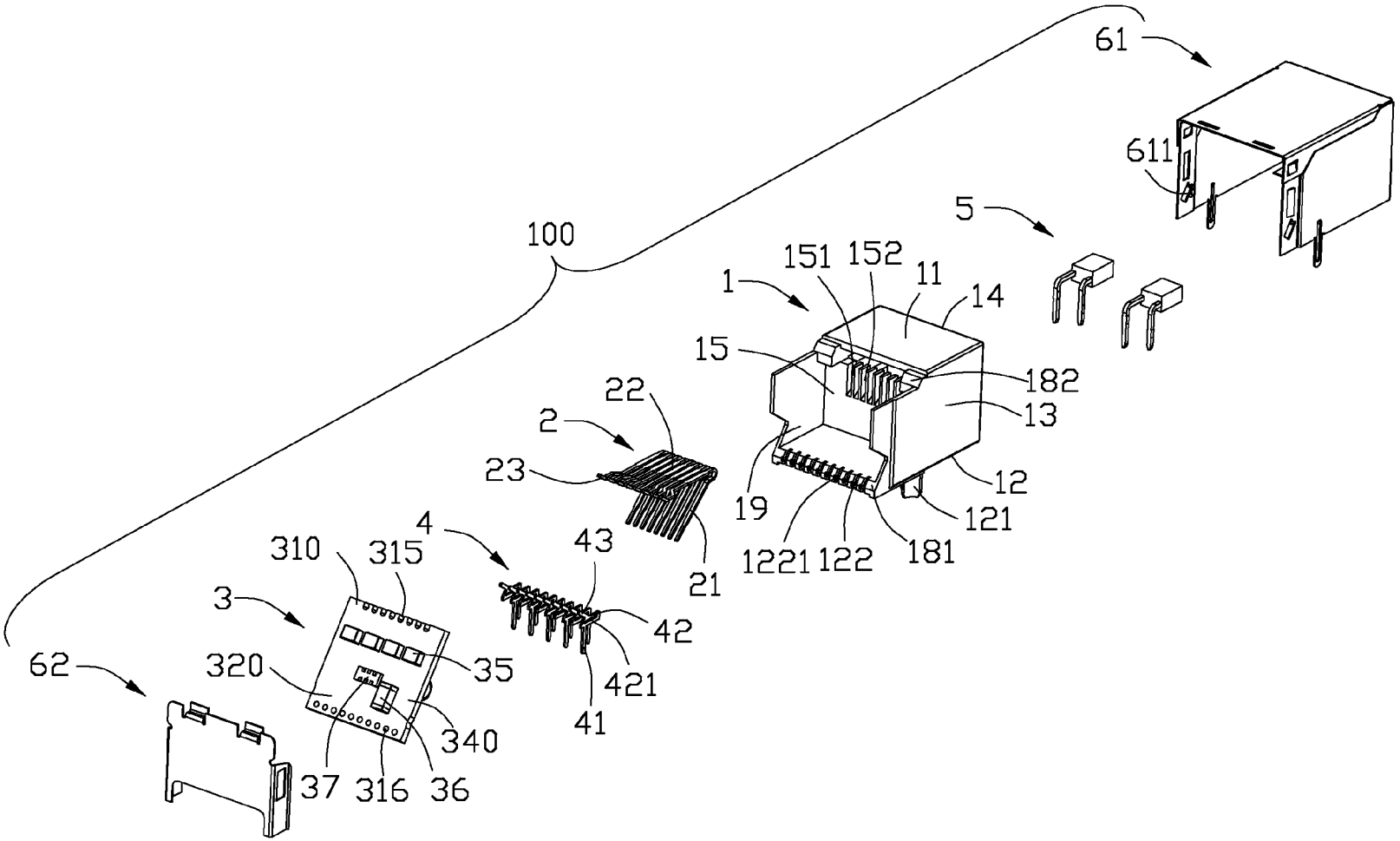
FIG. 2 is an exploded view of the modular jack as shown in FIG. 1.
Figure 3:
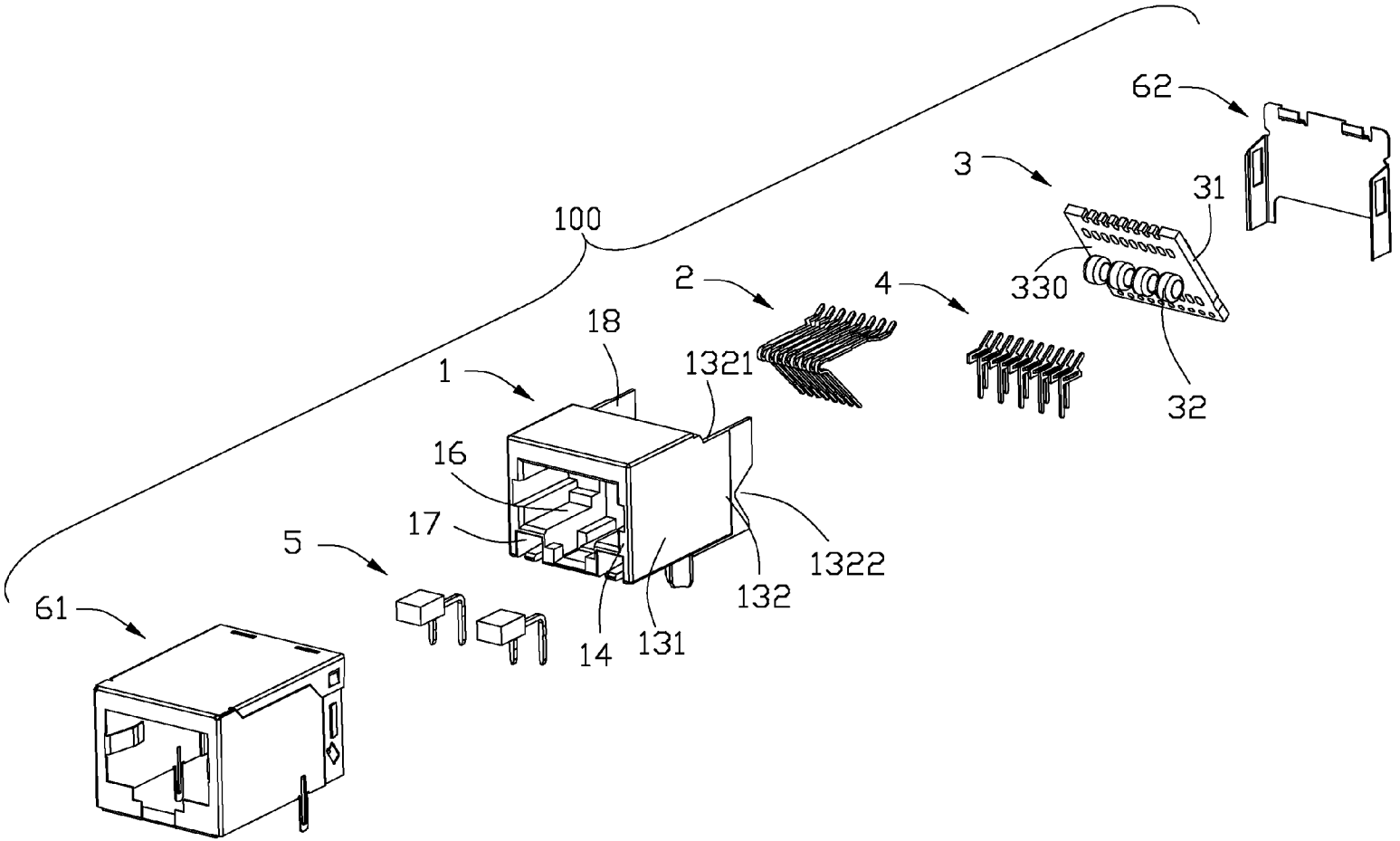
FIG. 3 is another exploded view of the modular jack as shown in FIG. 2.

Referring to FIGS. 1-3, a modular jack 100 has an insulative housing 1, a set of mating terminals 2, a printed circuit board assembly (PCBA) 3, a set of footer pins 4, two light emitting diodes (LEDs) 5 and a shielding shell 6. The modular jack 100 can be mounted on an exterior circuit board (not shown) and can be mated with a modular plug (RJ45).

The insulative housing 1 including a front wall 14, a bottom wall 12 extending horizontally along a front-to-back direction, a top wall 11 extending substantially parallel to bottom wall 12, two side walls 13 extending vertically along the front-to-back direction and a middle wall 15 disposed between the two side walls 13. The front wall 14 connects with the bottom wall 12 and the two side walls 13. The front wall 14 extends vertically along a left-to-right direction. The middle wall 15 extends substantially parallel to the front wall 10. The middle wall 15 divides the insulative housing 1 into a mating port 16 for receiving the modular plug and a mounting port 19 located behind of the mating port 16. Each of the two side walls 13 has a front portion 131 positioned in front of the middle wall 15 and a rear portion 132 positioned behind of the middle wall 15. The rear portions 132 of the side walls 13 together with the bottom wall 12 defines the mounting port 19. The top wall 11 is positioned in front of the mounting port 19. The mating port 16 is recessed from the front wall 14. Each of the rear portions 132 defines an upper cutout 1321 and a lower cutout 1322 located below the upper cutout 1321.

The middle wall 15 has a row of spaced grooves 152 and a plurality of spaced ribs 151 each positioned between two adjacent spaced grooves 152. The spaced grooves 152 connecting the mating port 16 with the mounting port 19. The mating terminals 2 are inserted from the mounting port 19 through the spaced grooves 151 to the mating port 16. The bottom wall 12 defines a row of fastening slots 122 for retaining footer pins 4 respectively. The fastening slots 122 are disposed at a rear edge of the bottom wall 12. Each fastening slot 122 defines a fastening passageway 1221 extending along the front-to-back direction. The bottom wall 12 has a mounting post 121 for inserting to an exterior circuit board (not shown). The inslulative housing 1 has two first inclined platforms 181 laterally positioned at two opposite sides of the row of fastening slots 122. The inslulative housing 1 also has two second inclined platforms 182 laterally positioned at two opposite sides of the row of spaced grooves 152. The inslulative housing 1 defines two mounting passageway 17 under the mating port 16 for the two LEDs 5 installing thereinto respectively.

The PCBA 3 is mounted to the mounting port 19. The PCBA 3 has a printed circuit board 31 and a plurality of electronic components mounted thereon. The printed circuit board 31 has an upper portion 310 and a lower portion 320. The printed circuit board 31 is disposed in the mounting port 19 in an oblique manner under condition that the upper portion 310 of the printed circuit board 31 is disposed in front of the lower portion 320. The upper portion 310 is supported by the second inclined platforms 182. The lower portion 320 is supported by the first inclined platforms 181. The printed circuit board 31 has a first surface facing 330 toward to the mating port 16 and a second surface 340 facing opposite to the first surface 330. The electronic components includes a plurality of isolated transformers 32 disposed on the first surface 330 and a plurality of common mode choke 35 disposed on the second surface 340. The electronic components also includes a capacitor 36 and a resistor 37 disposed on the second surface 340. The isolated transformers 32 has a toriod core and a plurality of coils wrapped thereon.

Figure 4:
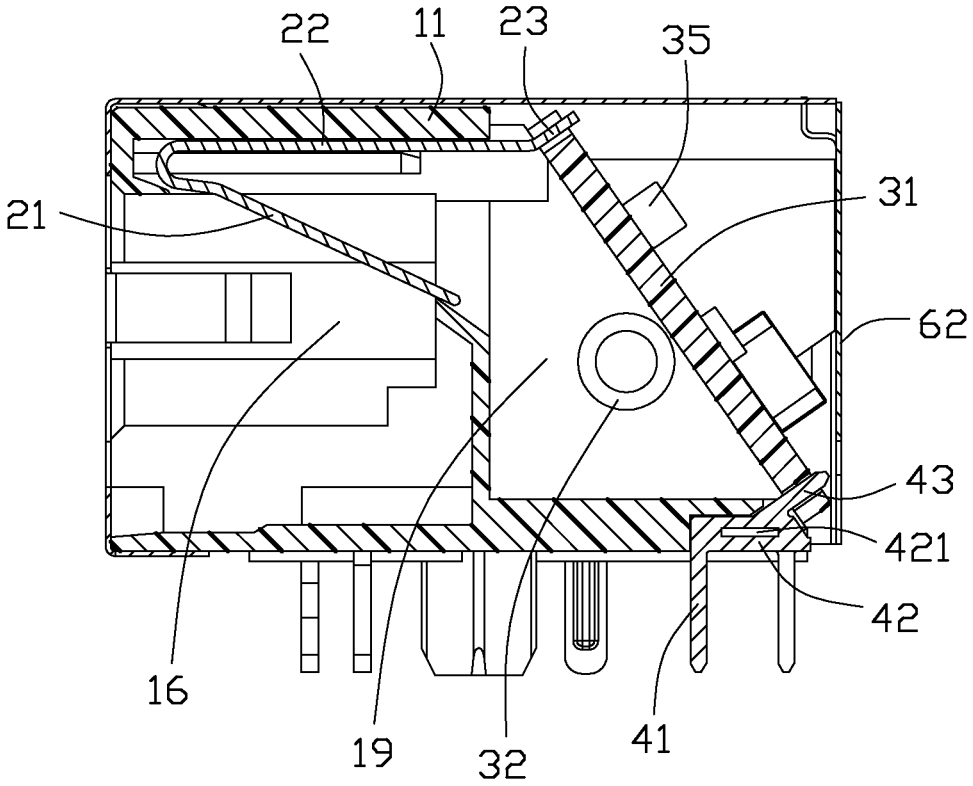
FIG. 4 is a cross-sectional view of the modular jack shown in FIG. 1, taken along line 4-4.

Referring to FIGS. 2-4, each mating terminal 2 has a contact portion 21 exposed to the mating port 16, a horizontal portion 22 displaced adjacent to the top wall 11 and a tail portion 23 connected to the upper portion 310 of the printed circuit board 31. The contact portion 21 extends downwardly and backwardly from the horizontal portion 22 in the mating port 16. The horizontal portion 22 extends along the front-to-back direction. The tail portion 23 extends upwardly and backwardly from the horizontal portion 22. The tail portion 23 extends perpendicular to the printed circuit board 31. The printed circuit board 31 defines a row of notches 315 positioned at the upper portion 310 for the tail portions 23 of the mating terminals 2 inserting thereinto respectively.

Each footer pin 4 has a mounting portion 41 for mounting onto an exterior substrate, a retention portion 42 fixed by the bottom wall 12 of the insulative housing 1 and a head portion 43 connected with a lower portion 320 of the printed circuit board 31. The mounting portion 41 extends downwardly beyond the bottom wall 12. The retention portion 42 extends along the front-to-back direction. The head portion 43 extends upwardly and backwardly from the retention portion 42. The head portion 43 extends perpendicular to the printed circuit board 31. The printed circuit board 31 defines a row of holes 316 positioned at the lower portion 320 for the head portions 43 of the footer pins 4 inserting thereinto respectively. The retention portion 42 is received in the fastening slots 122. The retention portion 42 has a protrusion 421 extending along the front-to-back direction and hold in the fastening passageway 1221. The footer pins 4 are directly hold by the insulative housing 1 for omitting an insulative carrier to reduce manufacturing cost.

The shielding shell 6 includes a front metal shell 61 and a rear metal shell 62. The front metal shell 6 are assembled together with the rear metal shell 62 for enclosing the insulative housing 1 and PCBA 3.

Figure 5:
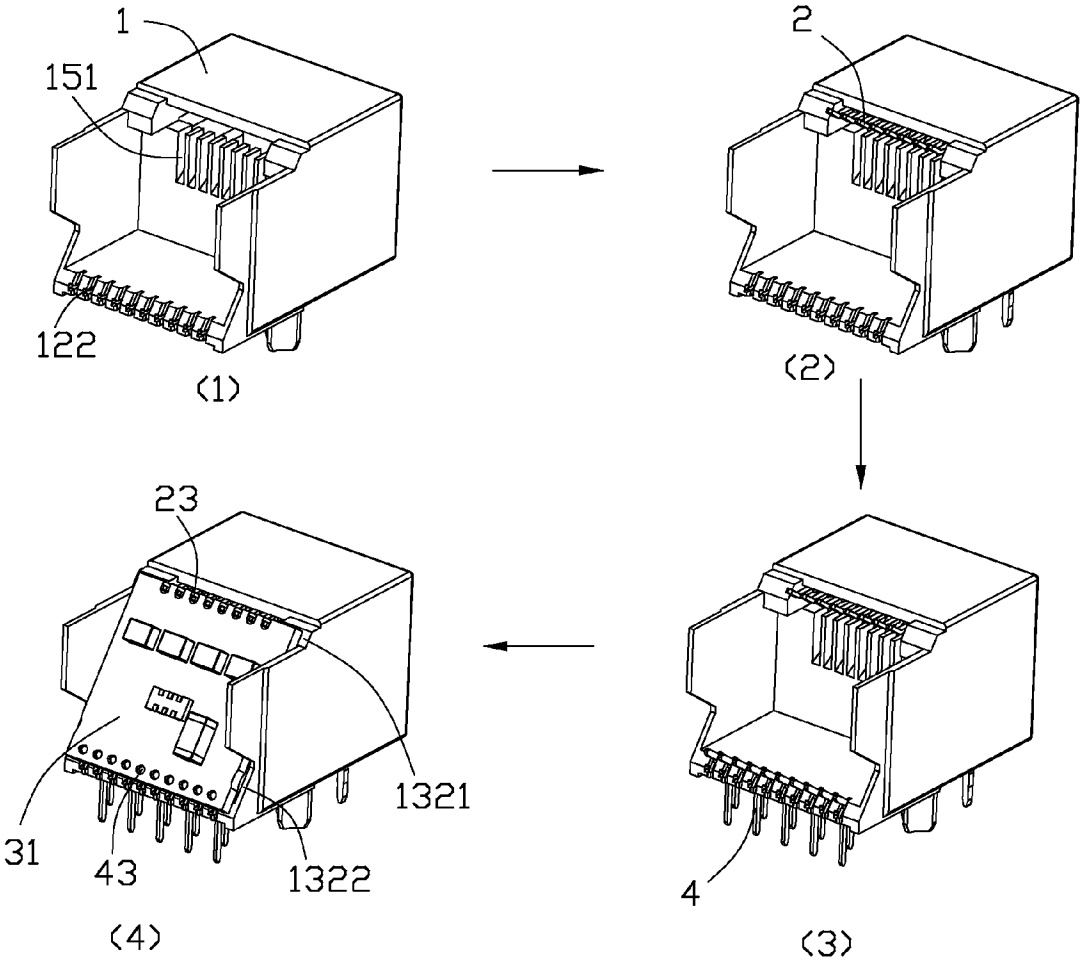
FIG. 5 is an assembling flow chart of the modular jack shown in FIG. 1.

Referring to FIG. 5, the assembling flow chart of the modular jack 100 includes flowing step: (1). providing an insulative housing 1; (2). providing a set of mating terminals 2 and assembling them through the spaced grooves 151 into mating port 16; (3). providing a set of footer pins 4 and assembling them to fastening slots 122 respectively; (4). providing a PCBA 3 and installing it to the mating terminals 2 and the footer pins 4; (5). soldering the tail portions 23 and the head portions 43 to the printed circuit board 31 through an automatical soldering machine along a transverse direction (a left-to-right direction or a right-to-left direction). All of the aforementioned process could be completed by an automation machine. The soldering process of the mating terminals 2 and the footer pins 4 could be finished in one continual process though setting the upper cutouts 1321 and the lower cutouts 1322. The tail portions 23 of the mating terminals 2 extend perpendicular to the printed circuit board 31 for easy assembling and soldering.

Figure 6:
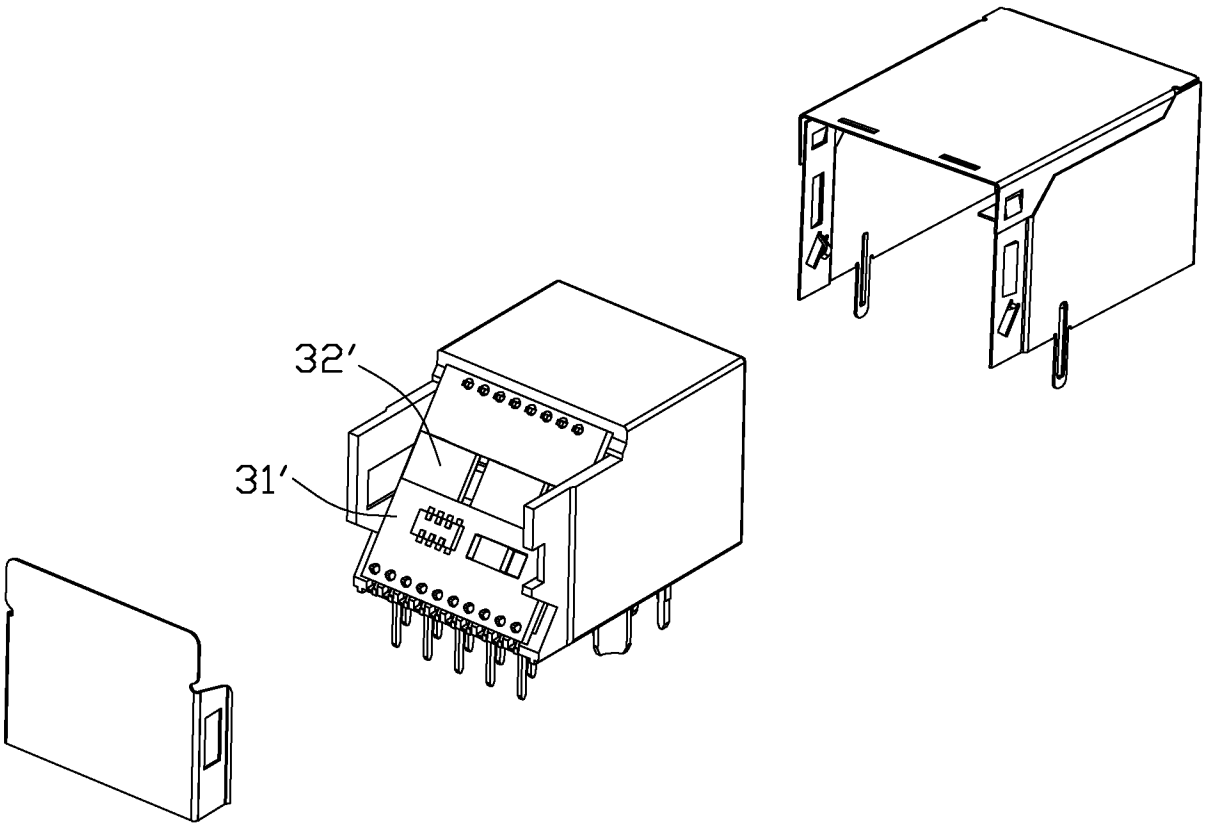
FIG. 6 is an exploded view of another embodiment of the modular jack.
Figure 7:
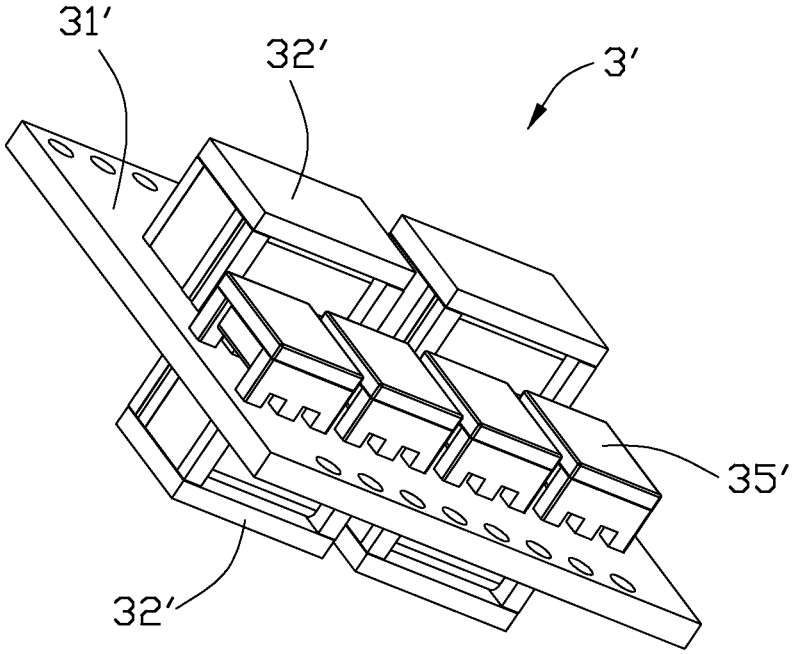
FIG. 7 is a perspective view of a printed circuit board assembly shown in FIG. 6.

FIGS. 6-7 illustrate a second embodiment of the present invention.

The difference between the first and second embodiments is the PCBA. The PCBA 3' of the second embodiment are different from the first embodiment's in that the isolated transformers 32' are packaged as a surface mounted type. The isolated transformers 32' could be manufactured by an automation machine, however the isolated transformers 32 of the first embodiment should be wrapped by human. The isolated transformers 32' also could be mounted easily to the printed circuit board 31' than the isolated transformers 32 of the first embodiment. The isolated transformers 32' are mounted on different surfaces of the printed circuit board 31'. The common mode choke 35' is surfaced mounted on a same surface.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A modular jack comprising:

a one piece inslulative unitary housing including a bottom wall, two side walls, a front wall connecting with the bottom wall and the two side walls, and a middle wall extending parallel with the front wall, the middle wall dividing the inslulative housing into a mating port for receiving a modular plug and a mounting port located behind of the mating port, the mating port being recessed from the front wall, the inslulative housing having a mounting post extending downwardly from the lower wall for inserting into an exterior substrate;

a printed circuit board having an upper portion and a lower portion, the printed circuit board disposed in the mounting port in an oblique manner under condition that the upper portion is disposed in front of lower portion and is thus closer to the middle wall than the lower portion in a front-to-back direction so as to have an extension plane of the printed circuit board oblique to the front-to-back direction;

a set of mating terminals each having a contact portion exposed to the mating port and a tail portion connected with the upper portion; and a set of footer pins each having a mounting portion for mounting onto the exterior substrate, a retention portion fixed by the bottom wall of the inslulative housing, and a head portion connected with the lower portion.

2. The modular jack as claimed in claim 1, wherein each of the two side walls has a front portion positioned in front of the middle wall and a rear portion positioned behind of the middle wall, the rear portions of the side walls together with the bottom wall defining the mounting port, the front portions of the side walls together with the bottom and top walls defining the mounting port, the printed circuit board disposed between the rear portions.

3. The modular jack as claimed in claim 1, wherein said printed circuit board defines a row of notches positioned at the upper portion for the tail portions of the mating terminals inserting thereinto respectively, each tail portion extending perpendicular to the printed circuit board.

4. The modular jack as claimed in claim 1, wherein said bottom wall of the inslulative housing has a row of fastening slots for retaining footer pins respectively, the bottom wall of the inslulative housing has two first inclined platforms laterally positioned at two opposite sides of the row of fastening slots, the lower portion of the printed circuit board placed upon the first inclined platforms.

5. The modular jack as claimed in claim 1, wherein said middle wall has a row of spaced grooves connecting the mating port with the mounting port, the inslulative housing having two second inclined platforms laterally positioned at two opposite sides of the row of spaced grooves, the upper portion of the printed circuit board placed upon the second inclined platforms, the mating terminals inserted in the spaced grooves respectively.

6. The modular jack as claimed in claim 1, wherein said printed circuit board has a first surface facing toward to the mating port and a second surface facing opposite to the first surface, the modular jack further including a plurality of isolated transformers mounted on the first surface and a plurality of common mode choke mounted on the second surface.

7. The modular jack as claimed in claim 6, wherein said isolated transformers packaged as a surface mounted type, each isolated transformer having a plurality of conductive pads for soldering onto the printed circuit board.

8. The modular jack as claimed in claim 1, wherein the retention portions of the footer pins are arranged in a low along a transverse direction.

9. The modular jack as claimed in claim 1, wherein the footer pins include a first footer pin and a second footer pin, the retention of the first footer pin extending backwardly, the retention of the second footer pin extending frontwardly.

10. The modular jack as claimed in claim 1, wherein the inslulative housing defines two mounting passageway under the mating port for the two light emitting diodes installing respectively.

11. A modular jack comprising:

a one piece insulative unitary housing including a middle wall cooperating with opposite top and bottom walls, which are opposite to each other in a vertical direction, and opposite two sides walls, which are opposite to each other in a transverse direction perpendicular to said vertical direction, to commonly define a front mating port;

a mounting port formed behind the middle wall opposite to the mating port;

a plurality of grooves extending through the middle wall in a front-to-back direction which is perpendicular to both said vertical direction and said transverse direction, each of said grooves further extending through the top wall;

a plurality of contacts configured to be forwardly inserted into the corresponding grooves from the mounting port and terminated at the mating port, each of said contacts including a stationary horizontal section retained in the top wall, and a deflectable oblique section linked to a front end of the horizontal section with a free end abutting against the middle wall in a preloaded manner; and an inner printed circuit board obliquely assembled to the housing between two opposite side walls in a side view; wherein said printed circuit board defines an upper edge region far away from a bottom face of the housing while being close to the middle wall to have tails of the stationary horizontal sections connected thereto, and a bottom edge region far away from the middle wall while close to a bottom face of the housing, and a plurality of conductive footer pins are connected to the bottom edge region with legs downwardly extending below the bottom face of the housing for mounting to an external printed circuit board on which the housing is seated; wherein said printed circuit board extends in a plane oblique to both said front-to-back direction and said vertical direction while parallel to said transverse direction.

12. The modular jack as claimed in claim 11, wherein the bottom wall extends rearwardly beyond the middle wall with a rear end adjacent to the bottom edge region of the printed circuit board to retain the footer pins therein.

13. The modular jack as claimed in claim 12, wherein a pair of upper platforms is formed around an upper end of the middle wall, and a pair of lower platforms is formed around the rear of the bottom wall, against which the inner printed circuit board abuts for supporting consideration.

14. The modular jack as claimed in claim 11, wherein each of the tails of the stationary horizontal sections forms an upward oblique end section to connect to the upper edge region of the printed circuit board in a perpendicular manner.

15. The modular jack as claimed in claim 11, wherein a rear end of the top wall is terminated around the middle wall so as to allow the inner printed circuit board to be assembled to the tails of the corresponding stationary horizontal sections of the contacts and the footer pins downwardly in an oblique direction rather than forwardly along the front-to-back direction.

16. The modular jack as claimed in claim 11, further including a metallic shell enclosing the housing, wherein said inner printed circuit board is directly upwardly exposed to the shell.

17. A method of assembling a modular jack, comprising steps of:

providing a one-piece insulative unitary housing with opposite top and bottom walls, which are opposite to each other in a vertical direction, and opposite two side walls and a middle wall, which are opposite to each other in a transverse direction perpendicular to said vertical direction to commonly define a front mating port;

providing a mounting port behind the middle wall;

providing a plurality of through grooves in the middle wall along a front-to-back direction, which is perpendicular to both vertical direction and said transverse direction, each of said grooves further extending into the top wall;

initially forwardly inserting a plurality of contacts into the grooves from the mounting port and through the middle wall and terminated at the mating port to have a stationary horizontal section retained in the top wall and a deflectable oblique section with a free end retained by the middle wall in a preloaded manner; and successively assembling an inner printed circuit board into the mounting port of the housing and having an upper edge region of the printed circuit board close to the middle wall while far away from a bottom face of the housing, and a lower edge region of the printed circuit board far away from the middle wall while being close to the bottom face of the housing so as to have said printed circuit board extend in a plane oblique to both said vertical direction and said front-to-back direction in a side view; wherein tails of the stationary horizontal sections of the contacts are connected to the upper edge region of the printed circuit board.

18. The method as claimed in claim 17, wherein the printed circuit board is assembled downwardly to the tails of the stationary horizontal sections of the contact along an oblique direction.

19. The method as claimed in claim 18, further including a step of providing a plurality of footer pins around the bottom face of the housing to connect to the lower region of the printed circuit board.

20. The method as claimed in claim 19, wherein said bottom wall rearwardly extends beyond the middle wall and is terminated around the lower region of the printed circuit board to have the footer pins are retained therein.

* * * * *